US005256090A

United States Patent [19]

Woolley

[11] Patent Number: 5,256,090

[45] Date of Patent: Oct. 26, 1993

[54] VARIABLE-APERTURE JET NOZZLE FOR JET-PROPELLED WATERCRAFT

[76] Inventor: Russell C. Woolley, 4433 W. Avenida Del Sol, Glendale, Ariz. 85310

[21] Appl. No.: 994,513

[22] Filed: Dec. 21, 1992

[51] Int. Cl.[5] ..... B63H 11/107

[52] U.S. Cl. ..... 440/40; 239/265.37

[58] Field of Search ..... 440/39, 40, 41, 42, 440/43, 47; 239/265.19, 265.37, 455

[56] References Cited

U.S. PATENT DOCUMENTS

| | | | |
|---|---|---|---|
| 3,982,494 | 9/1976 | Posti | 490/41 |
| 4,538,997 | 9/1985 | Haglund | 440/41 |
| 4,708,671 | 11/1987 | Watanabe | 440/41 |
| 4,929,200 | 5/1990 | Guezou et al. | 440/47 |
| 5,049,096 | 9/1991 | Henn | 440/41 |
| 5,062,815 | 11/1991 | Kobayashi | 440/41 |
| 5,067,918 | 11/1991 | Kobayashi | 440/39 |

FOREIGN PATENT DOCUMENTS

| | | | |
|---|---|---|---|
| 2242320 | 4/1973 | Fed. Rep. of Germany . | |
| 1338139 | 8/1963 | France . | |
| 1342642 | 9/1963 | France . | |
| 1492084 | 7/1967 | France . | |
| 65491 | 3/1991 | Japan | 440/47 |
| 588501 | 5/1947 | United Kingdom | 239/265.37 |

*Primary Examiner*—Jesús D. Sotelo

*Attorney, Agent, or Firm*—Antonio R. Durando; Harry M. Weiss

[57] ABSTRACT

An accessory device that produces a variable-aperture orifice in the outlet pipe of conventional water-jet nozzles. In one embodiment, the attachment is mounted on the exterior of the outlet pipe; in another, it is installed as an insert inside the outlet pipe. The device comprises two opposite, substantially semi-cylindrical shells slidably coupled along their longitudinal edges and hingedly connected at one end to form a cylindrical structure which is capable of deformation at the other, free end to produce a variable cross-section. The aperture of the structure at the hinged end is sized to fit tightly with the size of the nozzle's outlet pipe, while the cross-section at the free end may be progressively reduced by clamping the two shells together. A clamping mechanism, such as a hydraulic bladder or a cable-driven clamp, is mounted around the free end and is used to reduce its cross-sectional size during operation of the watercraft. When the clamping mechanism is released, the shells are pushed open by the operating pressure of the water jet through the nozzle.

16 Claims, 2 Drawing Sheets

VARIABLE-APERTURE JET NOZZLE FOR JET-PROPELLED WATERCRAFT

BACKGROUND OF THE INVENTION

1. Field of the Invention

This invention pertains to the general field of jet-powered watercraft. In particular, it provides a device for increasing the versatility of factory-installed propulsion and steering nozzles of small watercraft.

2. Description of the Related Art

Jet-propelled watercraft have recently become very popular for sport and entertainment because of their versatility and relatively simple construction. In particular, the type of craft designed for one-person use, often called "jet skis," have become as common at recreational water resorts as snowmobiles have been for years at winter resorts. The power units of these boats generally contain an internal combustion engine that drives a jet propulsion assembly consisting of an impeller housed in the rear portion of the hull. The impeller is rotatably journaled in a tunnel between a water inlet port and a discharge nozzle which provides both propulsion and steering to the craft. The nozzle is pivotally mounted on a support frame in the back of the craft and tied to control linkage that permits a user to vary the direction of the water jet, thus providing means for steering the unit. In addition, a mechanism for reversing the direction of flow of the water, such as a reverse-thrust bucket, is normally hingedly mounted on the nozzle of larger boats and controlled by a separate linkage system.

The prior art teaches many different variations of watercraft jet-propulsion nozzles which incorporate features for improving the performance of the watercraft. For example, U.S. Pat. No. 3,982,494, issued to Posti (1976), describes an auxiliary rudder for improving the lower-speed manuverability of a jet-powered craft. The rudder is coupled to the water pressure generated by the impeller so as to rise out of the water at high speeds, thus eliminating unwanted drag that would affect performance when the engine is under high load. The rudder is functional at low speeds only, when maneuverability is harder to achieve by jet propulsion alone and when the engine can afford the power loss resulting from the additional friction loss.

In U.S. Pat. No. 4,538,997 (1985), Haglund discloses a system of baffles incorporated in the body of the nozzle for providing varying degrees of back thrust. The invention is directed at overcoming the problem of conventional bucket-like thrust-reversing means which project beneath the hull and tend to slow down the watercraft.

U.S. Pat. No. 4,708,671 to Watanabe (1987) discloses another thrust-reversing device that is designed to permit the reversal of the direction of the water jet exhausted from the nozzle without protruding below the hull of the craft. This is achieved by adding channels in the bottom of the boat that conform with the curved ends of the device.

U.S. Pat. No. 5,049,096 to Henn (1991) describes an accessory attachment for conventional watercraft nozzles for increasing the directional control of the water jet and improving the fluid-flow characteristics of the jet. The device uses internal vanes to reduce the spiralling motion imparted by the impeller on the water jet and comprises a directional control to improve the side-to-side movement of the nozzle.

In U.S. Pat. No. 5,062,815 (1991), Kobayashi describes a drive control for effecting operation of a watercraft in either a forward or reverse drive mode while a rider is accommodated in a straddled position. In U.S. Pat. No. 5,067,918 (1991), the same inventor discloses a mechanism for deflecting the flow at the discharge nozzle to form a rooster-tail effect. The invention includes a modified reverse-thrust bucket with a clearance that permits the formation of the tail without affecting the reverse-thrust function of the unit.

Finally, French Patents No. 1,338,139 (1963) and No. 1,342,642 (1963), issued to Dowty Technical Development Limited, French Patent No. 1,492,084 (1967), issued to Perrier et al., and German Patent No. 2,242,320 (1973), issued to Smith, all describe various apparatus for improving the performance of watercraft jet-propulsion systems.

These prior-art devices are designed primarily to reduce drag and increase maneuverability by providing improved directional flow of the water jet. None of them have a direct affect on the pressure or velocity of the jet stream, which remain controlled only by the impeller's speed. Although many different approaches have been adopted in the referenced disclosures, none is directed at improving the performance of jet nozzles by providing a variable cross-section exhaust duct. In fact, manufacturers systematically choose the nozzle aperture's size to best balance the top- as well as the bottom-end speed of the craft. Since the performance of the impeller is greatly affected by small variations in the cross-section of the nozzle's outlet orifice, providing an adjustable aperture is an effective means for adding flexibility to the conventional control systems of small watercraft.

Therefore, there remains a need for an improved water-jet nozzle that permits a user to continuously vary the size of the nozzle's orifice during operation, thus providing an added degree of flexibility in controlling the maneuverability and performance of the watercraft. The present invention describes such a device as an accessory attachment for conventional nozzles.

BRIEF SUMMARY OF THE INVENTION

One objective of this invention is the development of a water-jet nozzle that permits the continuous variation of the exhaust-water pressure and velocity by controlling the size of the nozzle's orifice.

Another goal is an apparatus that utilizes the power generated by the watercraft's impeller to assist in providing the motion required for the functioning of the mechanism of the invention.

Another objective of the invention is a device that can be used as an accessory attachment for standard jet-ski nozzles, so that exhisting watercraft may be retrofitted with minimal labor to improve their performance.

Still another goal is a conversion kit that can be installed internally on water-jet nozzles of larger boats equipped with reverse-thrust mechanisms, so as to have no affect on the appearance of the watercraft.

Finally, an object of the invention is a design for the apparatus that is conducive to manufacture utilizing simple components that are either already available in the open market or that can be produced at competitive prices.

According to these and other objectives, the present invention consists of an accessory attachment for the outlet pipe of conventional water-jet nozzles. In one embodiment, the attachment is mounted on the exterior of the outlet pipe; in another, it is installed as an insert inside the outlet pipe. The invention comprises two opposite, substantially semi-cylindrical shells slidably coupled along their longitudinal edges and hingedly connected at one end to form a cylindrical structure which is capable of deformation at the other, free end to produce a variable cross-section. The aperture of the structure at the hinged end is sized to fit tightly with the size of the nozzle's outlet pipe, while the cross-section at the free end may be progressively reduced by clamping the two shells together. A clamping mechanism, such as a hydraulic bladder or a cable-driven clamp, is mounted around the free end and is used to reduce its cross-sectional size during operation of the watercraft. When the clamping mechanism is released, the shells are pushed open by the operating pressure of the water jet through the nozzle.

Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DETAILED DESCRIPTION OF THE INVENTION

The main point of this invention is the idea of providing an accessory attachment for varying the aperture of the water-jet nozzle of conventional jet-powered boats during operation. Currently, the power of jet-propelled boats is controlled only by varying the speed of the impeller, which determines the water throughput at the nozzle. For a fast take-off, the throttle of the engine driving the impeller is opened all the way and the boat is allowed to accelerate according to the physical characteristics of its propulsion system, which are fixed. Boat users know that larger jet nozzles produce higher top speeds, but also result in lower acceleration on take-off. Therefore, the orifice of nozzles is designed for a balanced performance. This invention provides a means for varying the orifice aperture during use, so as to increase the acceleration on take-off and improve the craft's maneuverability at low engine speed (RPM) without sacrificing top speed.

Figure 1:
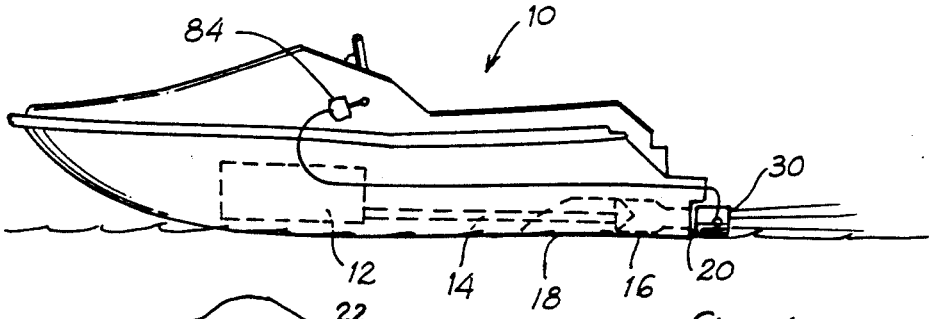
FIG. 1 is a side elevational view of a small, ski-jet watercraft retrofitted with the nozzle attachment of this invention.

Referring to the drawings, wherein like parts are designated throughout with like numerals, FIG. 1 illustrates in side elevational view a small, jet-ski type of watercraft 10 retrofitted with one embodiment of the apparatus 30 of the invention. An engine 12, through a shaft 14, drives an impeller 16 which draws water from an inlet port 18 at the bottom of the craft and discharges it at high velocity through a nozzle 20. The nozzle 20 is pivotally mounted on the stern of the boat and is connected to a linkage machanism that controls its side-to-side direction. Typically, the outlet portion of the nozzle 20 consists of a uniform cylindrical pipe a few inches long.

Figure 2:
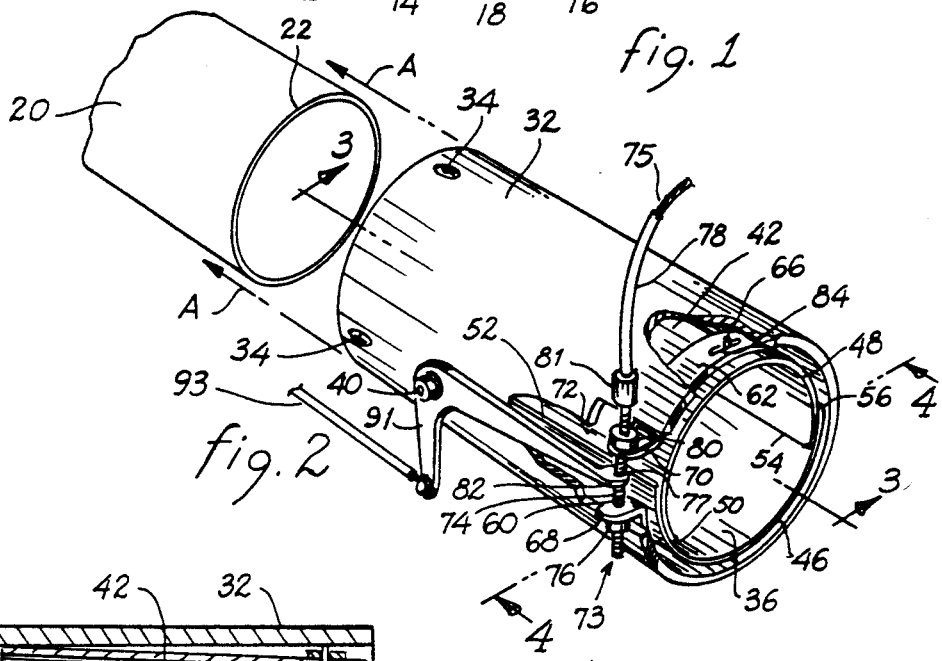
FIG. 2 is a partially cut-out perspective view of the apparatus of the invention according to one embodiment designed for attachment to the outlet pipe of the nozzle of small, ski-jet watercraft.
Figure 3:
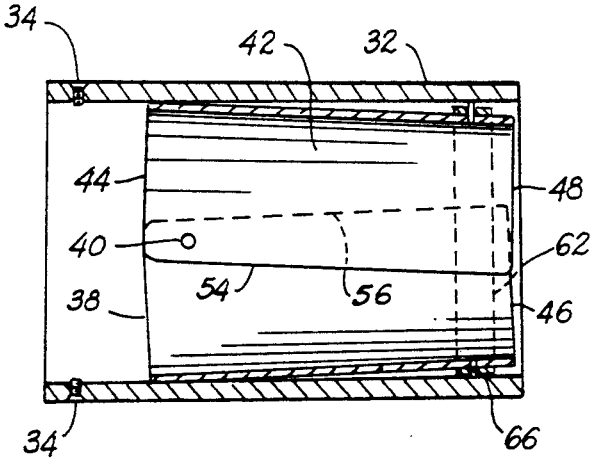
FIG. 3 is a cross-sectional side view of the retrofit apparatus of FIG. 2, as seen from line 3—3 in that figure.
Figure 4:
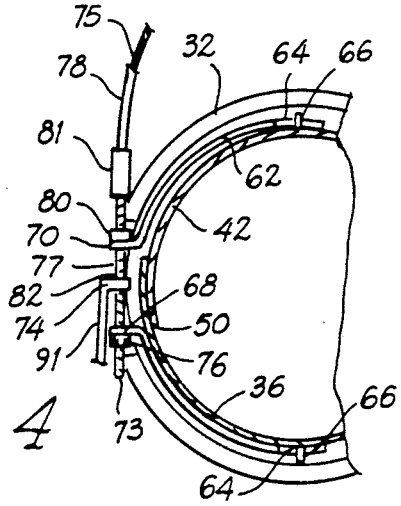
FIG. 4 is a partial end view of the retrofit apparatus of FIG. 2, as seen from line 4—4 in that figure.

With reference to the partially cut-out view of FIG. 2, the preferred embodiment of the apparatus 30 of the present invention comprises a cylindrical outer sleeve 32 adapted for installation over the outlet pipe 22 of the watercraft's nozzle 20, as illustrated in FIG. 1. Preferably, the inside diameter of the sleeve 32 is only slightly larger than the outside diameter of the outlet pipe 22, so that the sleeve may be fitted tightly over the pipe. The outer sleeve 32 contains retaining means, such as set screws 34 or other equivalent devices, for removably affixing the sleeve to the outlet pipe of the nozzle 20, so that it becomes a rigid portion thereof. As also seen in Figures 3 and 4, the sleeve 32 contains a substantially semi-cylindrical lower shell 36 mounted longitudinally within the sleeve, having two straight edges substantially parallel to the main axis of the sleeve and in contact with the sleeve, and having a front portion 38 hingedly connected thereto by means of two hinge-pins 40 installed radially and opposite to one another through the sleeve. A substantially semi-cylindrical upper shell 42 is similarly arranged above the lower shell 36 inside the sleeve 32. The front portion 44 of the upper shell is also hingedly connected to the sleeve (and to the lower shell) by means of the two hinge-pins 40 to form a clam-shell structure within the sleeve. The circular perimeter of the two shells 36 and 42 is sufficiently greater than that of a semi-cylindrical structure to provide some overlap between the upper and lower longitudinal edges 50 and 52, respectively, on one side and between the upper and lower longitudinal edges 54 and 56, respectively, on the other side of the apparatus (FIG. 2). In addition, the radius of each shell is only slightly smaller than that of the sleeve 32, so that the shells conform to the inner surface of the sleeve and fit tightly within it. Thus, the rear portions 46 and 48 of the lower and upper shells, respectively, are not attached to the sleeve 32, but are constrained by the geometry of the sleeve to form a substantially circular aperture. The shells 36 and 42 are constructed of low-friction, flexible material (preferably aluminum or steel) that makes it possible to compress the two shells concentrically to form a variable iris-like aperture at their free end. Finally, the shells 36 and 42 are shorter than the sleeve 32 and are mounted back of the retaining means 34, so that the apparatus can be installed on a nozzle by unobstructedly sliding the sleeve over the outlet pipe 22 of the nozzle, as indicated by the arrows A in FIG. 2. In order to avoid the formation of turbulence and back pressure within the nozzle, it is important that the sleeve 32 fit tightly over the nozzle's outlet pipe 22 and that the thickness of the upper and lower shells be smaller than that of the outlet pipe, so that the front edges of the shells do not form a ridge in the trajectory of flow of the water through the nozzle.

As assembled, the upper and lower shells 42 and 36 can be compressed to slide over one another by increasing the amount of overlap along the longitudinal edges, thus producing a progressively smaller aperture at the back of the nozzle. The compression of the upper and lower shells is accomplished by means of a clamp assembly 60 disposed within the sleeve 32 around the free, rear portions 46 and 48 of the shells. In the preferred embodiment of the invention, the clamp assembly 60 consists of an open clamp 62 wrapped around the two shells inside the sleeve. The clamp is slidably mounted through slots 64 on retaining clips 66 protruding from each shell, so that the clamp is free to slide peripherally but not longitudinally as the shells are compressed or are allowed to expand. The two clamp-ends 68 and 70 protrude from an opening 72 in the sleeve 32 and are coupled by a double-pitch, worm screw 73 (normally referred to as a jack screw) connected to a rotating cable assembly that provides the driving force required to compress or expand the clamp to reduce or increase the aperture between the upper and lower shells. As is typical of this type of rotating-cable control, the worm screw 73 comprises two separate sections threaded in opposite directions and screwably coupled to the clamp-ends of the clamp 62. The first, distal section 74 of the screw 73 cable is connected to the clamp-end 68 by means of a threaded nut 76 attached thereto, while the second, proximal section 77 of the worm screw is connected to the other clamp-end 70 by means of a threaded nut 80 similarly attached to it, but with threads running in the opposite direction. One end of a flexible cable 75 is attached to the worm screw 73 by means of a coupling nut 81. Thus, when the cable is rotated, the worm screw 73 turns with it and the clamp-ends 68 and 70 are either drawn together or pushed apart, depending on the direction of rotation. The cable 75 is housed in a flexible cable sheath 78, which is positioned to run to a point within the comfortable reach of a rider of the watercraft, where the other end of the cable is connected to a control mechanism 84, as illustrated in FIG. 1, thus enabling the rider to compress the clamp 62 to restrict the nozzle aperture. The control mechanism 84 preferably consists of a reversible electric motor capable of rotating the cable 75 in either direction, depending on the position of an actuating mechanical lever operated by the rider, but it could equivalently consist of other cable-driving apparatus actuated by a switch. Thus, the cable is adapted to compress the clamp when its driving mechanism rotates in one direction, and to expand the clamp when the driving mechanism rotates in the opposite direction. When the clamp is expanded, the pressure of the water jet passing through the nozzle provides the force necessary to open the nozzle's orifice to its maximum aperture.

Finally, an additional mechanism may be provided for fine adjustments of the direction of the water jet exiting the nozzle. Since in their clamped state the rear portions 46 and 48 of the lower and upper shells occupy a smaller cross-section than in their expanded state, they can be pivoted around the axis of the hinge-pins 40 for movement up or down within the sleeve 32. This movement can be exploited to further change the thrust characteristics of the nozzle in what is normally referred to as "trimming." To that effect, the first arm of an L-shaped lever 91 may be hinged to the hinge-pin 40 aligned with the opening 72 and connected to a trim-adjustment anchor 82 in the worm screw 73. Thus, as the second arm of the lever 91 is pulled or pushed, as may be affected by appropriate linkage 93, the anchor 82 and the rear portions 46 and 48 of the shells are moved down or up, respectively, changing the direction of flow of the water jet. Given the dimensions of the preferred embodiment of the invention listed below, it is found that a total trim of 6 degrees (that is a travel of 3 degrees up and 3 down) is possible when the diameter of the aperture defined by the shells is reduced by 0.25 inches (6.6 mm).

Figure 5:
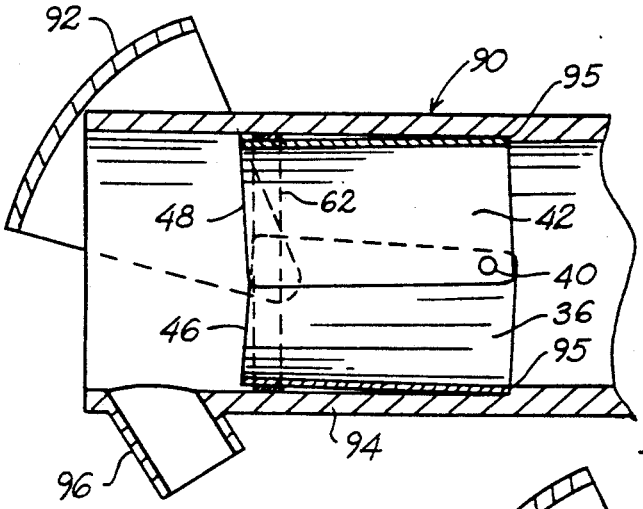
FIG. 5 is a cross-sectional side view of a nozzle that comprises a reverse-thrust bucket and duct, as illustrated in the larger watercraft of FIG. 8, retrofitted according to another embodiment of the present invention.
Figure 6:
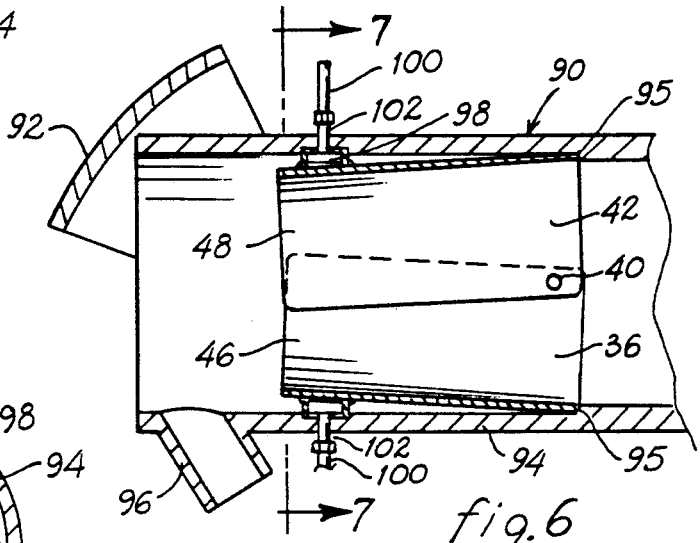
FIG. 6 illustrates yet a different embodiment of the retrofitted nozzle of FIG. 5, using a hydraulic bladder for the clamping mechanism of the invention.
Figure 7:
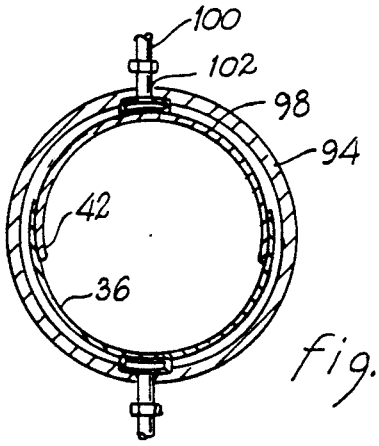
FIG. 7 is a cross-sectional view of the retrofitted nozzle of FIG. 6 as seen from line 7—7 in that figure.
Figure 8:
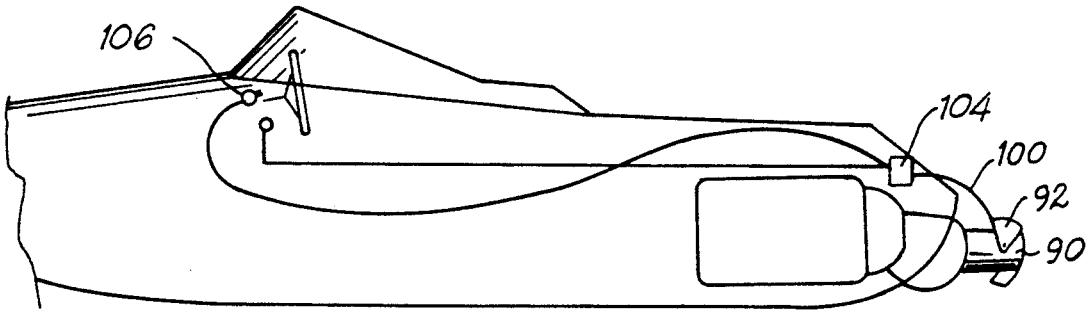
FIG. 8 is a partial, side elevational view of a larger watercraft having a water-jet nozzle that incorporates a reverse-thrust bucket and duct.

FIGS. 5–7 illustrate another embodiment of the invention for nozzles of jet propulsion systems equipped with reverse thrust. Typically, in these systems the nozzle 90 comprises a reverse-thrust bucket 92 hingedly mounted on the end portion of a forward outlet-pipe 94 and a reverse outlet-pipe 96 pointed downward and forward under the boat. The bucket 92 is adapted to remain in an upper position, clear of the water-jet (see FIG. 8), during normal forward thrust of the propulsion system, and to swing down to completely block and divert the water flow through the reverse outlet pipe when the system is operated in the reverse-thrust mode.

Thus, the reverse-thrust bucket prevents the use of the attachment described in FIGS. 1–4 with this type of nozzle. The embodiments shown in FIGS. 5–7 are substantially the same, but may be implemented by utilizing the cylindrical structure of the factory-built nozzle as the sleeve within which the collapsible shells of the invention are installed. The interior surface of the nozzle 90 is machined to create a radial recess 95 having at least the same thickness of the material used to manufacture the clam shells of the invention, so that they may be fitted within the recess to provide a ridgeless, preferably smooth surface at the interface between the nozzle and the shells. The lower shell 36 and the upper shell 42 are mounted against the recess 95 inside the forward outlet-pipe 94, upstream of the reverse outlet-pipe 96, and are hingedly secured by means of two radial hinge-pins 40 installed opposite to one another on the outlet-pipe 94. As in the first embodiment, the two shells 36 and 42 overlap along their longitudinal edges and are only slightly smaller than that outlet-pipe 94, so that the shells conform to the inner surface of the pipe and fit tightly within it to form a substantially circular aperture. By compressing concentrically the perimeter of the shells 36 and 42, the two shells provide a variable aperture for the nozzle's outlet.

The compression of the upper and lower shells is also accomplished by a clamp assembly disposed within the nozzle 90 around the free, rear portions 46 and 48 of the shells. In the embodiment of FIG. 5, the clamp assembly 60 consists of the same structure described in FIGS. 2 and 4, comprising an open clamp 62 wrapped around the two shells inside the sleeve. The clamp-ends (not seen in the cross-sectional view of FIG. 5) protrude from an opening cut in the nozzle and are coupled to a cable control assembly for compressing and expanding the clamp 62 at will, as illustrated in FIG. 2.

In a different clamp assembly, illustrated in FIGS. 6 and 7, the clamping action is provided by a fluid-filled annular bladder 98 mounted around the shells 36 and 42 inside the nozzle. The bladder is made of stretchable material, such as rubber, and is connected to a hydraulic-fluid supply line 100 by means of one or more taps 102 through the nozzle housing. The line 100 is fed by a hydraulic pump 104, which in turn is controlled by a switch 106 that permits a user to either increase or decrease the hydraulic pressure in the bladder 98. Obviously, as the pressure increases the volume of the expandable bladder also increases forcing the aperture defined by the upper and lower shells 36 and 42 to constrict. When the flow of the hydraulic fluid is reversed, releasing the pressure in the bladder, the bladder shrinks and allows the expansion of the upper and lower shells to increase the size of the nozzle's aperture. Again, the water pressure through the nozzle provides the force required to cause the shells to expand.

Thus, the embodiments of the invention disclosed herein provide various ways of converting a standard nozzle into a variable-aperture nozzle, which adds desirable versatility to the performance of the watercraft. In operation, the nozzle aperture is pinched to its smallest diameter when maximum acceleration is desired from standstill (that is, to minimize the time required to "come out of the hole," which is defined by people in the field as the time the boat takes to go from a dead stop to a planing position over the water). The aperture is then allowed to expand to obtain maximum jet efficiency for high-speed operation. During the course of a race involving numerous obstacles that require sharp turns with corresponding decelerations and accelerations, the apparatus of this invention makes it possible to optimize performance at all times by balancing the throttle setting with the nozzle's aperture.

The performance of a jet boat varies significantly with minor adjustments to the nozzle aperture. Since a reduction of the engine speed results from a reduction of the nozzle's aperture, the use of a variable-aperture nozzle causes the engine to operate at different points on its power curve as a function of the nozzle-aperture setting. If the nozzle is choked too much, it may cause back pressure and severe power loss. Therefore, a relatively small closure is sufficient for optimal flexibility of performance. I found that a maximum closure of the clam shells corresponding to a radial travel of about 0.25 inches (6.5 mm) is recommended. Tested on jet-boat type of watercraft, 18 to 21 feet in length, which are typically powered with a 320 HP engine and have a nozzle with an inside diameter of approximately 3 inches (7.5 cm), the apparatus of the invention was found to reduce the time required to reach a planing position from standstill from about 3.5 seconds to about 2.5 seconds.

In the preferred embodiment of the invention, the sleeve 32 is about 4 inches long (10.1 cm), the clam shells 36 and 42 are approximately 3 inches long (7.5 cm) and, as detailed above, they have an outside radius approximately equal to the inside radius of the sleeve in which they are mounted (typically 1.5 inches, or 3.8 cm), so that a tight fit is achieved. The optimal size of the shells is the same whether used in an existing nozzle (FIGS. 5–8) or in a separate attachment. When the shells are used in a separate attachment, as illustrated in FIGS. 1–4, the point of discharge is shifted approximately four inches (10 cm) backwards along the main axis of the boat. This also affects the performance of the craft by increasing the steering power of the nozzle and by shifting the planing characteristics of the hull, often resulting in the boat riding with a higher front end.

Modifications to the described steps and materials to fit particular nozzles would be obvious to one skilled in the art. Therefore, various changes in the details, steps and materials that have been described may be made by those skilled in the art within the principles and scope of the invention herein illustrated and defined in the appended claims. While the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent methods and products.

I claim:

1. A variable-aperture jet propulsion apparatus for a small jet watercraft having a cylindrical discharge nozzle, comprising:

(a) a cylindrical sleeve having a first end with an inside diameter sized for tight slidable connection over the cylindrical discharge nozzle of the watercraft, and having a second end facing backwards with respect to the forward direction of the watercraft;

(b) retaining means, incorporated within said first end of the sleeve, for securing said sleeve to the cylindrical discharge nozzle;

(c) a substantially semi-cylindrical lower shell mounted longitudinally within said sleeve, said lower shell having two straight edges substantially parallel to the sleeve, having a front portion hingedly connected thereto by means of two radial hinge-pins installed opposite to one another through the sleeve, and having a rear portion disposed toward said second end of the sleeve;

(d) a substantially semi-cylindrical upper shell disposed above said lower shell and having two straight edges substantially parallel to the sleeve, said upper and lower shells forming a substantially cylindrical, clam-shell structure inside said sleeve and having some overlap along said straight edges, and said upper shell having a front portion hingedly connected to the sleeve and to the lower shell by means of said two radial hinge-pins; and (e) means for clamping said upper and lower shells within said sleeve to produce a variable-aperture orifice in said second end of the sleeve.

2. The apparatus described in claim 1, wherein said second end of the sleeve comprises a radial opening; and wherein said means for clamping said upper and lower shells within said sleeve to produce a variable-aperture orifice consists of an open clamp wrapped around said two shells inside the sleeve, said clamp being slidably mounted on retaining clips protruding from each shell, and having two clamp-ends protruding from said radial opening in said sleeve and coupled to cable means for controlling the aperture of the clamp.

3. The apparatus described in claim 2, wherein said cable means for controlling the aperture of the clamp consists of a rotating worm screw connected to a rotating cable and having two separate sections threaded in opposite directions and screwably coupled to the clamp-ends of the clamp.

4. The apparatus described in claim 3, further comprising a cable-driving mechanism connected to said rotating cable and actuated by a control switch positioned within the comfortable reach of a rider of the watercraft.

5. The apparatus described in claim 4, wherein said cable-driving mechanism consists of a reversible electric motor.

6. The apparatus described in claim 2, further comprising trim-adjustment means coupled to said cable means for adjusting the vertical position of said aperture of the clamp.

7. The apparatus described in claim 1, wherein said retaining means consists of at least two set screws.

8. The apparatus described in claim 1, wherein said sleeve has an inside diameter of about 3 inches and is approximately 4 inches long, and said upper and lower shells are about 3 inches long and have an outside radius od about 1.5 inches.

9. The apparatus described in claim 1, wherein said means for clamping said upper and lower shells within said sleeve to produce a variable-aperture orifice consists of an expandable, fluid-filled annular bladder wrapped around said two shells inside the sleeve, said bladder being hydraulically connected to a fluid supply line by means of at least one tap through said sleeve, and wherein said line is hydraulically connected to a hydraulic pump controlled by a switch positioned within the comfortable reach of a rider of the watercraft.

10. A variable-aperture jet propulsion apparatus for a jet watercraft having a discharge nozzle with a uniform cylindrical wall containing a radial opening and incorporating a reverse-thrust mechanism, comprising:

(a) a substantially semi-cylindrical lower shell mounted longitudinally within the nozzle of the watercraft in front of the reverse-thrust mechanism and fitted within a radial recess machined in the wall of the nozzle, said lower shell having two straight edges substantially parallel to the nozzle, having a front portion hingedly connected thereto by means of two radial hinge-pins installed opposite to one another through the wall of the nozzle, and having a rear portion disposed toward the back of the watercraft.

(b) a substantially semi-cylindrical upper shell disposed above said lower shell and having two straight edges substantially parallel to the nozzle, said upper and lower shells forming a substantially cylindrical, clam-shell structure inside the nozzle and having some overlap along said straight edges, and said upper shell having a front portion hingedly connected to the nozzle and to the lower shell by means of said two radial hinge-pins; and (c) means for clamping said upper and lower shells within the nozzle to produce a variable-aperture orifice, said means consisting of an open clamp wrapped around said two shells inside the nozzle, said clamp being slidably mounted on retaining clips protruding from each shell, and having two clamp-ends protruding from said radial opening in the nozzle and coupled to cable means for controlling the aperture of the clamp.

11. The apparatus described in claim 10, wherein said cable means for controlling the aperture of the clamp consists of a rotating worm screw connected to a rotating cable and having two separate sections threaded in opposite directions and screwably coupled to the clamp-ends of the clamp.

12. The apparatus described in claim 11, further comprising a cable-driving mechanism connected to said rotating cable and actuated by a control switch positioned within the comfortable reach of a rider of the watercraft.

13. The apparatus described in claim 12, wherein said cable-driving mechanism consists of a reversible electric motor.

14. The apparatus described in claim 10, wherein said upper and lower shells are about 3 inches long and have an outside radius of about 1.5 inches.

15. The apparatus described in claim 10, further comprising trim-adjustment means coupled to said cable means for adjusting the vertical position of said aperture of the clamp.

16. A Variable-aperture propulsion apparatus for a jet watercraft having a discharge nozzle with a uniform cylindrical wall containing a radial opening and incorporating a reverse-thrust mechanism, comprising:

(a) a substantially semi-cylindrical lower shell mounted longitudinally within the nozzle of the watercraft in front of the reverse-thrust mechanism and fitted within a radial recess machined in the wall of the nozzle, said lower shell having two straight edges substantially parallel to the nozzle, having a front portion hingedly connected thereto by means of two radial hinge-pins installed opposite to one another through the wall of the nozzle, and having a rear portion disposed toward the back of the watercraft;

(b) a substantially semi-cylindrical upper shell disposed above said lower shell and having two straight edges substantially parallel to the nozzle, said upper and lower shells forming a substantially cylindrical, clam-shell structure inside the nozzle and having some overlap along said straight edges, and said upper shell having a front portion hingedly connected to the nozzle and to the lower shell by means of said two radial hinge-pins; and (c) means for clamping said upper and lower shells within the nozzle to produce a variable-aperture orifice, said means consisting of an expendable, fluid-filled annular bladder wrapped around said two shells inside the nozzle, said bladder being hydraulically connected to a fluid supply line by means of at least one tap through the wall of the nozzle, and wherein said line is hydraulically connected to a hydraulic pump controlled by a switch positioned within the comfortable reach of a rider of the watercraft.

* * * * *